US007475968B2

(12) United States Patent
Watanabe et al.

(10) Patent No.: US 7,475,968 B2
(45) Date of Patent: Jan. 13, 2009

(54) INK-JET HEAD

(75) Inventors: Hideo Watanabe, Hachioji (JP); Osamu Murata, Hino (JP); Tetsuo Okuno, Hino (JP)

(73) Assignee: Konica Minolta Holdings, Inc., Tokyo (JP)

( * ) Notice: Subject to any disclaimer, the term of this patent is extended or adjusted under 35 U.S.C. 154(b) by 333 days.

(21) Appl. No.: 11/221,517

(22) Filed: Sep. 8, 2005

(65) Prior Publication Data

US 2006/0055741 A1 Mar. 16, 2006

(30) Foreign Application Priority Data

Sep. 16, 2004 (JP) ..... 2004-269546

(51) Int. Cl.
*B41J 2/045* (2006.01)

(52) U.S. Cl. ..... 347/68

(58) Field of Classification Search ..... 347/50, 347/68, 70–72

See application file for complete search history.

(56) References Cited

U.S. PATENT DOCUMENTS 6,357,864 B1 * 3/2002 Sullivan et al. ..... 347/58
6,390,609 B1 * 5/2002 Shigemura et al. ..... 347/71

* cited by examiner

*Primary Examiner*—An H Do
(74) *Attorney, Agent, or Firm*—Cohen Pontani Lieberman & Pavane LLP

(57) ABSTRACT

An ink-jet head in which an ink emitting surface (front surface) for emitting ink from ink channels partitioned by piezo-electric driving walls is opposite to an ink supplying surface (rear surface) for supplying ink to the ink channels, wherein the printed circuit board which covers the ear parts of ink channels provides, wiring electrodes to be electrically connected to connecting wires which are extended to the rear surface to drive piezo-electric elements, and a recessed area (to work as a common ink chamber) which faces to ink channels to supply ink to the ink channels.

14 Claims, 10 Drawing Sheets

FIG. 8 ( a )
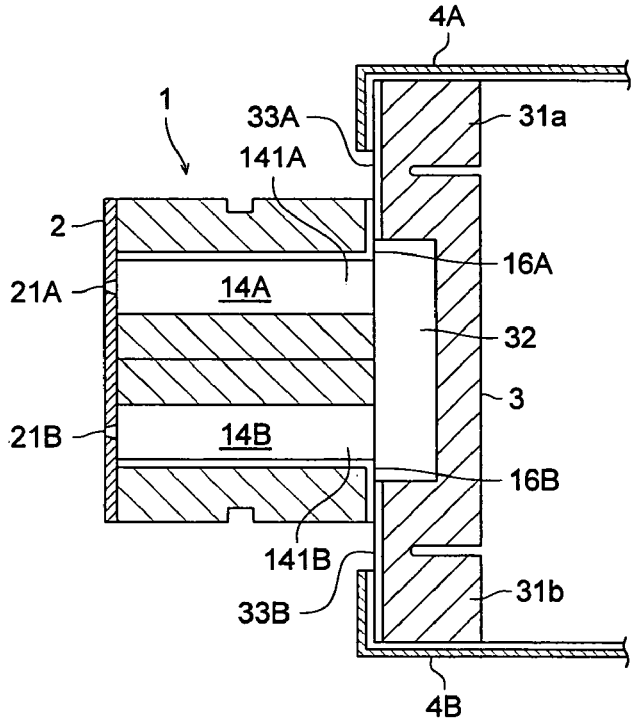
FIG. 8 ( b )
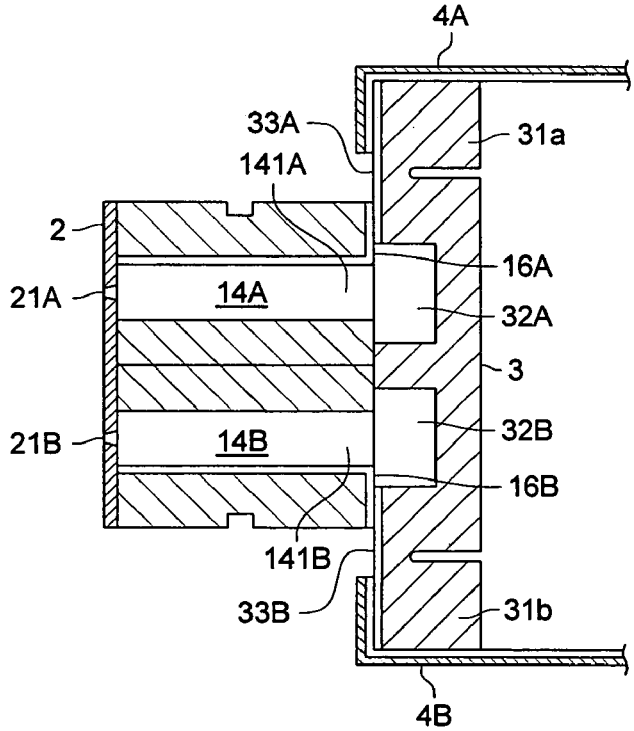

INK-JET HEAD

BACKGROUND OF THE INVENTION

1. Field of the Invention

This invention relates to an ink-jet head and more particularly to a low-cost ink-jet head which facilitates connection of driving electrodes ink-ink channels to external wirings and formation of a common ink chamber, which is compact and easy to produce, which generates little heat, and which is driven-by high frequencies.

2. Description of the Related Art

A conventional well-known ink-jet head is a shear-mode ink-jet head which emits ink from a channel which is cut in a piezo-electric substrate through a nozzle by applying a voltage to the electrodes of driving walls which partition channels and shear-deforming the driving walls. This ink-jet head uses a so-called harmonica-shaped head chip which comprises driving walls made of piezo-electric elements, channels partitioned by the driving walls, ink inlets placed in the front side of the channels, and ink outlets placed in the rear side of the channels. In this configuration of the harmonica-shaped head chip, the ink outlet, the channel, and the inlet are disposed approximately in a straight line. This configuration can increase the yield of head chips from a single wafer and the productivity of head chips.

In such an ink-jet head structure, the size and shape of the channel are approximately fixed between the inlet and the outlet. This is called a straight type channel. Further, the head chip must have electrodes provided outside the chip to supply a voltage to the driving electrodes of each driving wall from the electrodes on the FPC (flexible printed circuit).

There have been some technologies to provide such electrodes outside a head chip. Japanese Non-Examined Patent Publication H10-217456 discloses a technology of extending a wire which is connected to a driving electrode of each channel from the front side of the channel to the top or bottom surface of a head chip and connecting the wire to a driving circuit.

Japanese Non-Examined Patent Publication 2002-283560 discloses a technology of laminating a non-piezo-electric member on a piezo-electric element member having a channel groove, increasing the front and rear surfaces of the formed head chip with non-piezo-electric member, and forming an electrode to be electrically connected to the driving electrode on the surface (front or rear surface of the head chip) of the non-piezo-electric member.

Further, Japanese Non-Examined Patent Publication 2000-141653 discloses a technology of covering the all surfaces with a conductive layer and cutting thereof to isolate electrodes.

To extend the connecting electrode to the top or bottom surface of the head chip as disclosed in Japanese Non-Examined Patent Publication H10-217456, the wiring must pass through two surfaces (front or rear surface of the head chip and top or bottom surface of the head chip) from the driving electrode in each channel. Accordingly, two processes are required to form the connecting electrode: one for the front or rear surface of the head chip and the other for top or bottom surface of the head chip. This increases the man-hour and production cost of the print head. Further, the connecting electrode has a higher possibility of being damaged by sharp edges of the two surfaces.

Further, Japanese Non-Examined Patent Publication 2002-283560 provides non-piezo-electric members-to form connecting electrodes and widens the front and rear surfaces of the head chip. This increases the size of the head chip and goes against downsizing of the inkjet head. Worse still, it becomes harder to cut out head chips from laminated wafers since the laminated wafer is thicker than ever.

Further, the ink-jet head requires a common ink chamber for supplying ink to each channel. The common ink chamber must be so constructed to cover the channel inlets of channels in rows. This also increases the number of processes to produce the ink-jet head (a process of forming a connecting electrode which is electrically connectable to the FPC on the head chip and-a process of forming the common ink chamber). In other words, this makes the man-hour more complicated.

SUMMARY OF THE INVENTION

An object of this invention is to solve the above problems.

Another object of this invention is to reduce production processes and man-hours of ink-jet heads and provide inexpensive ink-jet heads.

Still another object of this invention is to provide ink-jet heads which facilitate external connection of channel driving electrodes and formation of a common ink chamber.

These and other objects are attained by an ink-jet head comprising, a plurality of piezo-electric driving walls which are provided at preset intervals in a preset direction, channels each of which is sandwiched by the driving walls to store ink, driving electrodes each of which is formed on the surface of the driving wall, connecting electrodes each of which is electrically connected to the driving electrode and extends to the rear of the channel, a printed circuit board which covers the rear part of the channels, wiring electrodes each of which is provided on the printed circuit board and electrically connected to each of the connecting electrodes, and a common ink chamber which is provided longitudinally in the preset direction on the printed circuit board to supply ink to the multiple ink channels.

The above object of this invention can be attained by an ink-jet head comprising, a plurality of piezo-electric driving walls which are provided at preset intervals in a preset direction, an upper substrate which covers the top surface of the driving walls, a lower substrate which covers the bottom surface of the driving walls, channels each of which is enclosed in driving walls, the upper substrate, and the lower substrate to store ink, driving electrodes each of which is formed on each driving wall, connecting electrodes each of which is electrically connected to the corresponding driving electrode and extends to the upper or lower substrate in the rear of the channel, a printed circuit board which covers the rear part of the channels, wiring electrodes provided on the printed circuit board to be electrically connected to the connecting electrodes, and a common ink chamber which is provided longitudinally in the preset direction on the printed circuit board to supply ink to the multiple ink channels.

The invention itself, together with further objects and attendant advantages, will best be understood by reference to the following detailed description taken in conjunction with the accompanying drawings.

BRIEF DESCRIPTION OF THE DRAWINGS

FIG. 7(*b*) shows that a heater is provided on the inner side of the printed circuit board.

FIGS. 8(*a*) and 8(*b*) respectively show a sectional view of an ink-jet head having two rows of channels.

In the following description, like parts are designated by like reference numbers throughout the several drawing.

DESCRIPTION OF THE PREFERRED EMBODIMENT

This invention will be described in further detail by way of embodiments with reference to the accompanying drawings.

Figure 1:
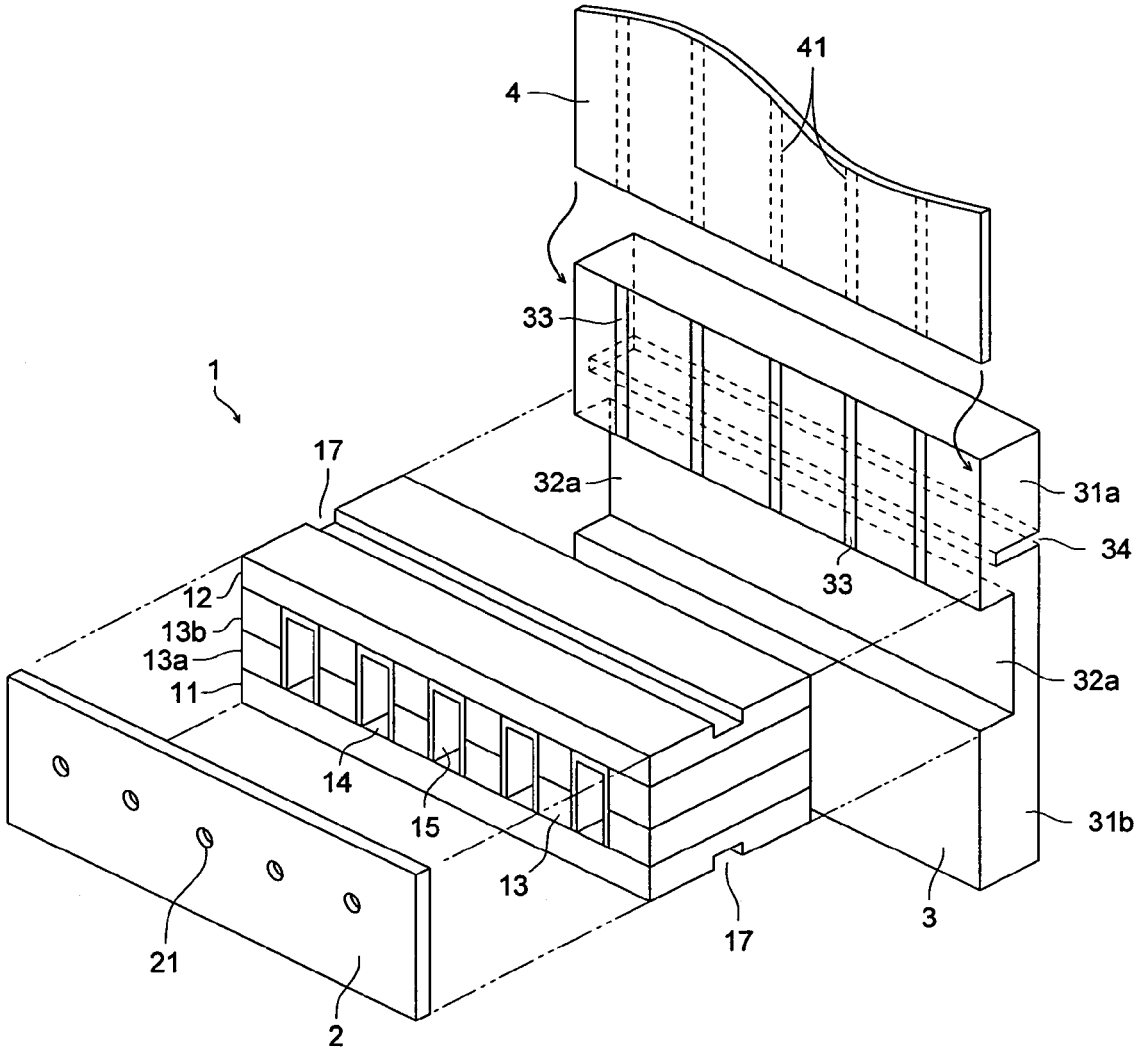
FIG. 1 is an exploded perspective view of the ink-jet head.
Figure 2:
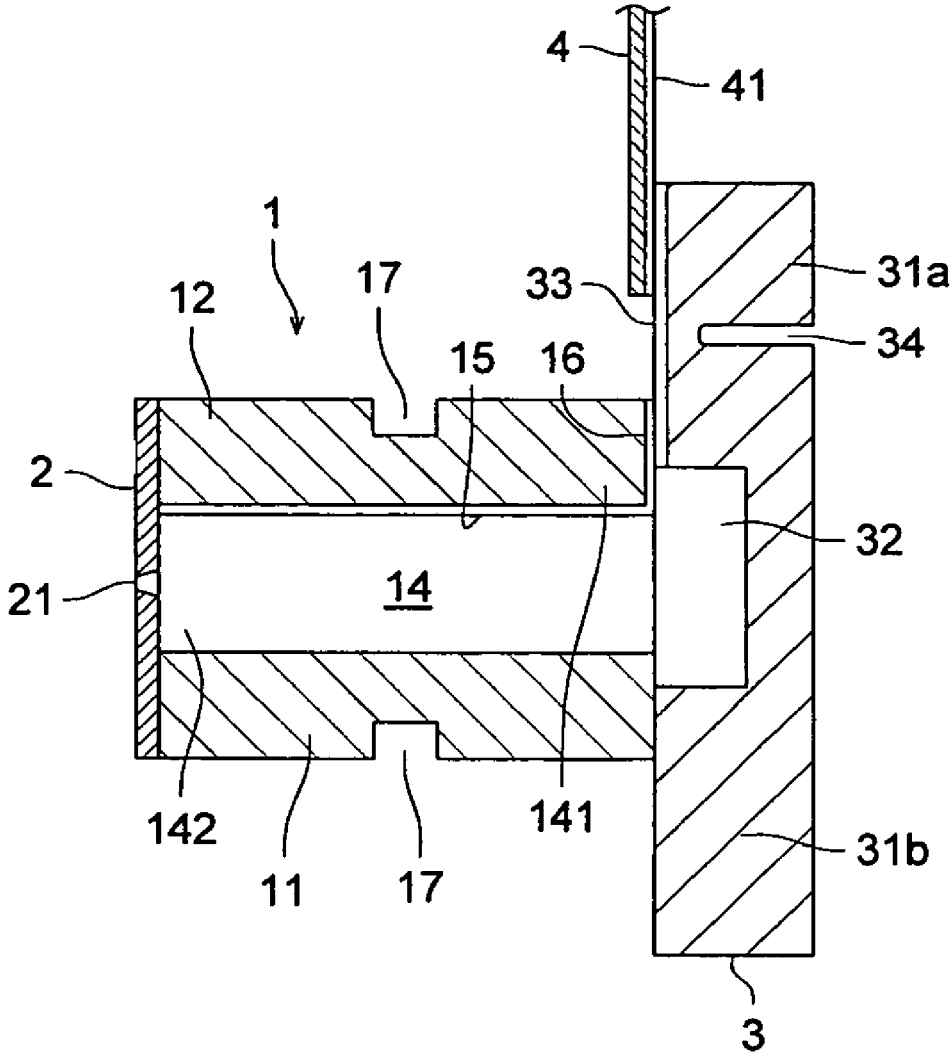
FIG. 2 is a sectional view of the ink-jet head.

FIG. 1 is an exploded perspective view of the ink-jet head and FIG. 2 is a sectional view of the ink-jet head. In these figures, head chip 1 comprises nozzle plate 2 attached to the front side of head chip 1, printed circuit board 3 attached to the rear side of head chip 1, and FPC 4 (flexible printed circuit) to be connected to printed circuit board 3.

In the description of this embodiment, the "front surface" means the surface of a side of head chip 1 from which ink is emitted. The "rear surface" is opposite the front surface. The outer surfaces at the top and bottom of the head chip which sandwich the channels are respectively called "top surface" and "bottom surface."

Head chip 1 comprises two substrates 11 and 12, driving walls 13 made of piezo-electric elements, and channels wherein driving walls 13 and channels 14 are alternately disposed between substrates 11 and 12. Driving walls 13 which form walls of each channel 14 are parallel to each other and approximately perpendicular to substrates 11 and 12. As shown in FIG. 2, head chip 1 has outlet 142 of each channel 14 on the front side of the head chip and inlet 141 on the rear side. Each channel 14 is of the straight type which is approximately identical in size and shape from inlet 141 to outlet 142. The straight type channel features quick bubble cutting, high power efficiency, low heat generation, and high response speed.

Figure 3:
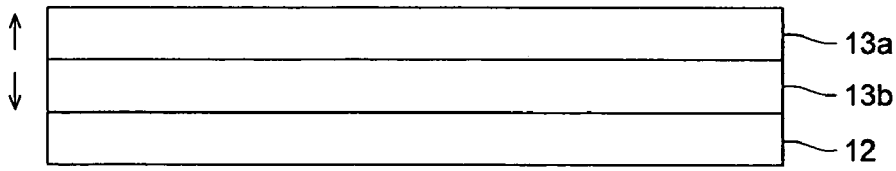
FIGS. 3(*a*), 3(*b*), 3(*c*) and 3(*d*) are explanatory drawings of production steps of a head chip.
Figure 3:
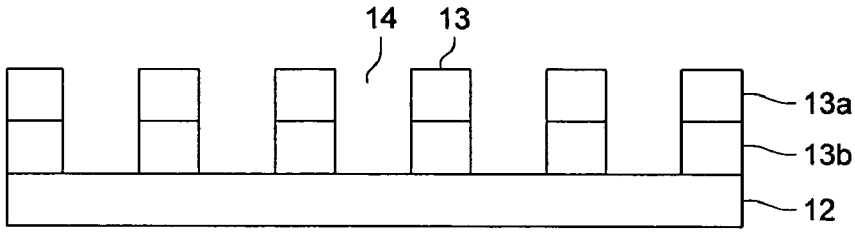
Figure 3:
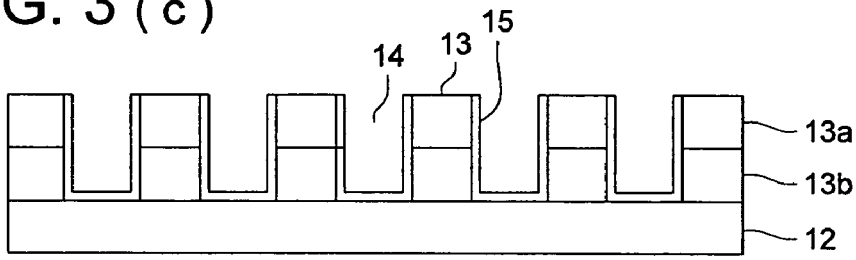
Figure 3:
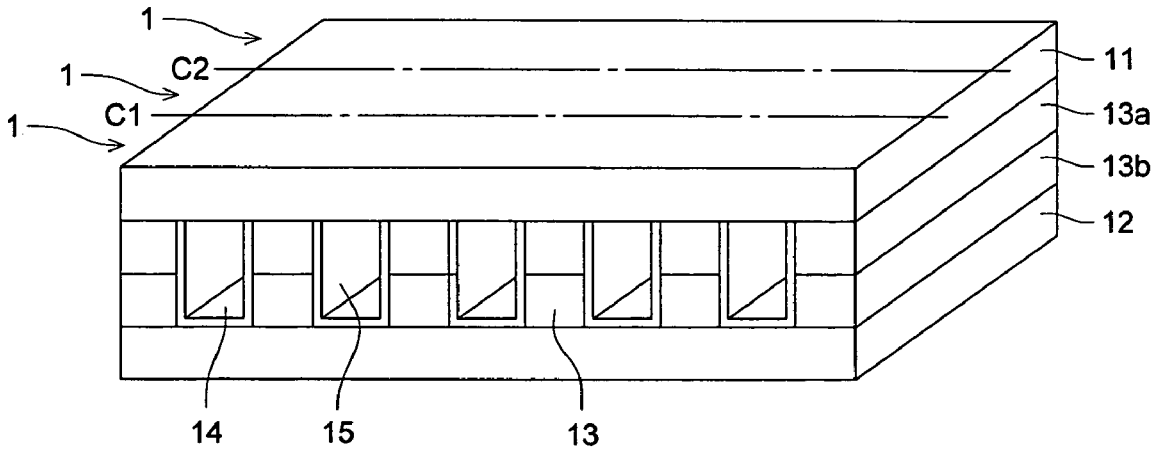

Such a head chip 1 can be produced first by bonding two piezo-electric substrates 13*a* and 13*b* to single substrate 12 with an epoxy adhesive (see FIG. 3(*a*)). Piezo-electric materials for substrates 13*a* and 13*b* can be any well-known piezo-electric materials which can deform when a voltage is applied. Particularly, lead zirconate titanate (PZT) is preferable as the piezo-electric material for substrates 13*a* and 13*b*. The two piezo-electric substrates 13*a* and 13*b* are placed on the substrate 12 with their polarizations reversed and bonded together with the adhesive.

A preset number of parallel grooves are formed on this laminated substrate by cutting out two piezo-electric layers 13*a* and 13*b* by dicing blades or the like. This provides a plurality of driving walls 13 each of which has upper and lower piezo-electric elements of different polarizations on the substrate 12. Since the grooves are cut at an almost fixed depth from one end of the laminated substrates 13*a* and 13*b* to the other end, the cut-out channels 14 are longitudinally almost identical in size and shape (which is called straight type channels) (see FIG. 3(*b*)). Since the polarizations of the two piezo-electric elements 13*a* and 13*b* which constitute each driving wall 13 are opposite to each other, the driving walls can shear-deform greatly and efficiently. As the result, the driving walls can give a high pressing force to ink in the channel 14. In other words, the ink-jet head can be driven at a low voltage, shoot ink droplets accurately, and consequently increase the print-out quality.

It is possible to laminate one thin piezo-electric substrate 13*a* and one thick piezo-electric substrate 13*b* without using substrate 12 and cut out parallel grooves in substrate 13*a* and halfway in substrate 13*b* (which is not shown in FIG. 3). In other words, piezo-electric substrate 13*b* works as substrate 12 and as the lower piezo-electric element of a driving wall 13 whose polarization is opposite that of piezo-electric substrate 13*a*.

Then, driving electrodes 15 are formed on the inner surfaces (walls) of each channel 14. Various kinds of metal such as Ni, Co, Cu, and Al are available to driving electrode 15, but Al and Cu are preferable judging from that their electric resistances are very low. However, Ni is more preferable in terms of corrosion resistance, withstanding strength, and production cost. Al plated with Au is also preferable.

The driving electrode 15 can be formed as a metal film by a vacuum method such as a deposition method, sputtering method, plating method, and chemical vapor deposition (CVD). However, a plating method is preferable and particularly, electroless plating is more preferable since this method can form uniform and pinhole-free metal films. The preferable plate thickness is 0.5 to 5 μm.

Since the driving electrodes 15 must be individually driven for channels 14, the top surface of each driving wall 13 should preferably be free from a metal film. For this purpose, it is preferable to cover the top surface of each driving wall 13 for example with a mask (resist) such as a dry film and remove the mask after forming a metal film on the channel walls. This method can selectively form driving electrodes 15 on inner walls of each driving wall 13 and the bottom of each channel (see FIG. 3(*c*)).

After formation of driving electrodes 15, substrate 11 is bonded to the top of the driving walls 13 with an epoxy adhesive. It is preferable to use the same piezo-electric material for substrates 11 and 12 as that for driving walls 13 because their thermal expansion coefficients are identical and cause almost no substrate warp and deformation when a driving heat generates.

Then, the head substrate assembly which laminates substrate 11, piezo-electric substrates 13*a* and 13*b* and substrate 12 is cut along two or more cutting lines C1, C2, and so on (which are perpendicular to the length of each channel)-into a plurality of harmonica-shaped head chips 1 (see FIG. 3(*d*)). The distance between two consecutive cutting lines (e.g. C1 and C2) determines the driving length (L) of each channel 14.

Positioning groove 17 (to be explained) can be formed on each head chip 1 by spot-facing shallowly (at a preset depth) between two consecutive cutting lines (e.g., C1, C2, and so on) simultaneously when the head substrate assembly is cut into head chips 1.

Connecting electrodes 16 are formed on the rear side of this head chip 1. Each connecting electrode 16 which is part of the driving electrode 15 extends from the bottom of each channel 14 (or the surface of substrate 12 in channel 14) to the rear end of substrate 12.

Figure 4:
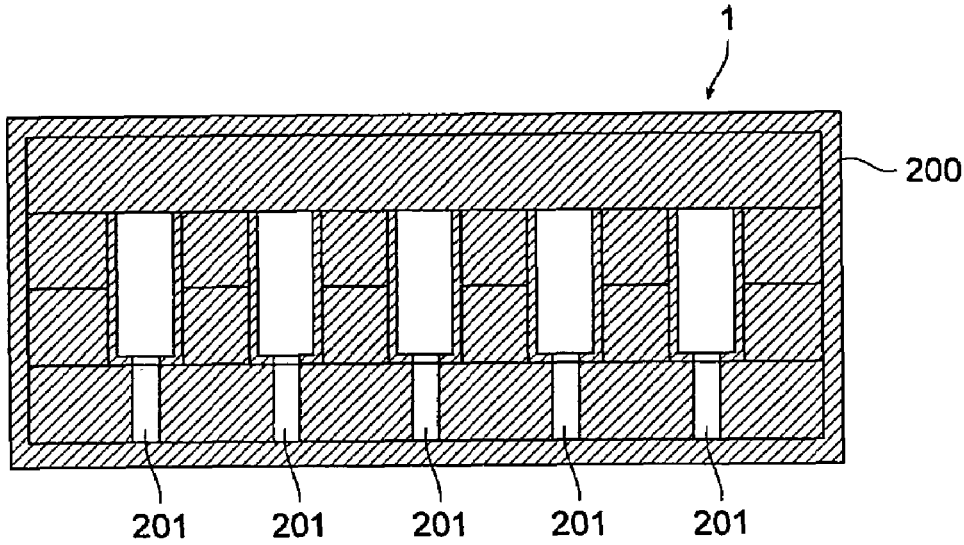
FIGS. 4(*a*) and 4(*b*) are explanatory drawings of formation of connecting electrodes.
Figure 4:
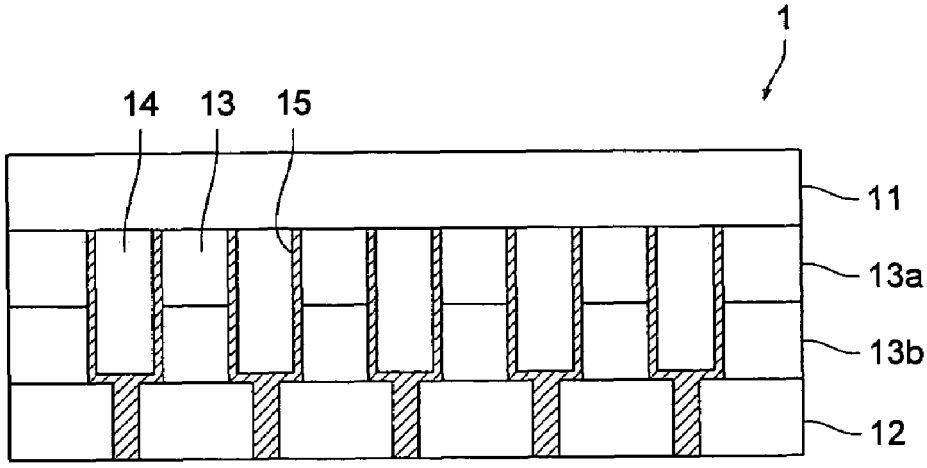

As shown in FIG. 4(*a*), these connecting electrodes 16 are formed by bonding photosensitive dry film 200 to one cut surface (rear surface) of head chip 1, exposing the dry film 200 to form unmasked areas 201 which contains at least part of driving electrode 15 on channel 14 and the end of substrate 12, developing, washing thereof, and depositing electrode metal such as Al on the unmasked areas. To ensure electric connections of the driving electrodes 15 and the connecting electrodes 16 in the channel, it is preferable in vapor deposition to tilt the rear surface of the head chip at a preset angle to the direction of deposition instead of making the rear surface of the head chip perpendicular to the direction of deposition. Substantially, the direction of deposition (along which metal particles fly) should preferably be at 30 to 60 degrees upward to the line perpendicular to the paper of FIG. 4(*a*). In this case, the deposited Al layer can be further plated with Au for lamination. Furthermore, it is possible to use a sputtering method instead of the depositing method to form the connecting electrodes 16.

In terms of workability in developing and washing processes of the photosensitive dry film 200, the unmasked area 201 should preferably contain the entire opening of the channel 14. This facilitates removal of the developing liquid and the washing liquid (water) from inside each channel 14.

Then, the photosensitive dry film 200 is removed from the cut surface of the head chip 1. With this, connecting electrodes 16 each of which is electrically connected to the driving electrode 15 of the corresponding channel 14 are provided on the cut surface (rear surface) of the head chip 1, as shower in FIG. 4(*b*). Since this connecting electrode 16 uses only the rear surface of the head chip 1 and does not use more surfaces, the connecting electrodes have a less possibility of being broken by layer edges.

By the way, the connecting electrodes 16 can be drawn to the substrate area of either substrate 11 or 12 on the rear surface of the head chip 1. In this example, the connecting electrodes 16 are drawn to the substrate area of substrate 12 on the rear surface of the head chip. This is preferable because the connecting electrode 16 can be drawn from the driving electrode 15 formed on the bottom of each channel 14. This can make the connecting electrode 16 narrower than the channel 14 and prevent shortcircuiting between two adjacent connecting electrodes 16. It is apparently possible to draw the connecting electrode 16 to the substrate area of substrate 11 on the rear surface of the head chip. In this case, the driving electrode 15 formed on one inner wall of each channel 14 or preferably both inner walls of the channel are used to draw out.

Nozzle plate 2 is attached to the front surface of head chip 1 and contains nozzle holes 21 which correspond one-to-one to channels 14.

Printed circuit board 3 which is bonded to the rear surface of head chip 1 is a single plate-like non-polarized substrate made of ceramic materials such as PZT, Al N-BN, and Al N. It can be made of plastic or glass material of low thermal expansion. The piezo-electric material used for head chip 1 is preferable if it is non-polarized. It is more preferable to select a material whose thermal expansion is within ±1 ppm in comparison with that of head chip 1 to suppress warpage of head chip 1 due to the difference in thermal expansion.

The printed circuit board 3 need not be a single-layer material. It can be a multiple-layer material prepared by laminating thin sheet-like substrates to have a desired board thickness.

The printed circuit board 3 is as wide as the head chip 1 and has projecting parts (banks) 31*a*, 31*b* which extend perpendicularly to the line of channels 14 (or a channel row), that is, in the vertical direction in FIG. 1 and FIG. 2 and project greatly from the top and bottom of the head chip 1 respectively. The printed circuit board 3 contains a recessed area 32 which extends across the printed circuit board 3 to-be attached to the rear surface of the head chip 1. This recessed area 32 is grooved so as to cover the inlets 141 of all channels 14 along the channel row of the head chip 1. In other words, the vertical length (width) of the recessed area 32 is greater than the height of each channel between substrates 11 and 12 but smaller than the thickness (the vertical length perpendicular to the channel row in FIG. 2) of the head chip 1. Accordingly, when the printed circuit board 3 is attached to the rear surface of head chip 1, the printed circuit board 3 touches the rear ends of substrate 11 and 12 but does not block the channel inlets 141. In this status, the channel inlets are open to the recessed area 32.

The recessed area 32 can be formed by various kinds of method such as grooving by dicing blades, ultrasonic cutting, and molding and sintering ceramic materials.

Projecting part (bank) 31*a* of the printed circuit board 3 is used to retain FPC (flexible printed circuit) 4. On the side facing to the head chip 1, bank 31*a* has-wiring electrodes 33 which are one-to-one related to connecting electrodes 16 on the rear surface of the head chip 1. The number and pitch of wiring electrodes 33 on bank 31 are the same as those of connecting electrodes 16 on the rear surface of the head chip 1. When FPC 4 is attached to bank 31*a*, the wiring electrodes 33 are electrically connected to wiring conductors 41 of the FPC 4 (to be electrically connected to driving circuits which are not shown in the drawing) and work to pass signals from the driving circuits to driving electrodes 15 in channels 14 of the head chip 1. Since the wiring electrodes 33 are provided on the bank 31*a* which greatly projects from the head chip 1, they can be easily aligned to the electrodes on the FPC 4.

The wiring electrodes 33 can be formed on the bank 31*a* by coating the surface of the printed circuit board 3 with a positive resist by a spin-coating method, applying light to the positive resist through a stripe mask (to form unmasked areas one-to-one corresponding to connecting electrodes 16 on the printed circuit board 3), developing the resist, and depositing metal for electrodes on the unmasked areas by a depositing or sputtering method. The metals for electrodes can be those used for the driving electrodes 15.

When the head chip 1 contains only one channel row as shown in FIG. 1 and FIG. 2, the printed circuit board 3 need not have upper and lower projecting parts (banks). The projecting part should be provided only on one side of the printed circuit board 3 to which the FPC 4 will be attached.

Transverse groove 34 (along the channel row) is provided on the back of the printed circuit board 3 (which is opposite the side to be attached to the head chip 1). It is rather closer to the end of the printed circuit board 3 than the rear end of the head chip 1. The groove 34 is cut deep (more than half the thickness of the projected printed circuit board 3) from the back surface of the printed circuit board 3 deep toward the front surface of the printed circuit board 3. This groove 34 works to reduce a stress on the junction between the head chip 1 and the printed circuit board 3 when FPC 4 is bonded to the surface of the projecting part 31*a* with an anisotropic conductive film or the like after the printed circuit board 3 is attached to the rear surface of the head chip 1. In other words, this groove can prevent warpage and connection failure of the head chip 1. The printed circuit board 3 can have two or more grooves 34. Its number is not limited to 1. To increase the durability to inks, the most preferable conductive material should be an anisotropic conductive epoxy adhesive paste which contains Ni or other metallic particles homogeneously therein.

The printed circuit board 3 is bonded to the rear surface of the head chip 1 with an anisotropic conductive film or the like after being aligned so that the wiring electrodes 33 may be one-to-one connected electrically to the connecting electrodes 16 of the head chip 1 and the recessed area 32 may cover the channel inlets 141. The other electric connecting methods are also available. They are methods used in ordinary packaging technology such as a pressure-welding method which uses a non-conductive adhesive and a soldering method which applies solder to at least either the wiring electrodes 33 or the connecting electrodes 16, applies unsoldered electrodes to soldered electrodes, and hot-connects these electrodes.

When the printed circuit board 3 is bonded to the rear surface of the head chip 1, the single recessed area 32 can complete electrodes (connecting electrodes 16 and wiring electrodes 33) to supply signals from driving circuits to driving electrodes 15 in channels 14 of the head chip 1 and a common ink chamber to supply ink to channel inlets 141 simultaneously.

Ink supply tubes or the like (not shown in the drawing) are connected to openings 32*a* at both ends of the recessed area (which works as a common ink chamber) to supply ink to the area. The tubes are connected when the printed circuit board 3 is attached to the rear surface of the head chip 1. Ink can be supplied into the recessed area 32 through either or both of the tubes.

It is also possible to provide a through-hole 35 which runs from the bottom of the recessed area 32 to the back of the printed circuit board 3 and connect an ink supply tube to the through-hole 35.

Figure 5:
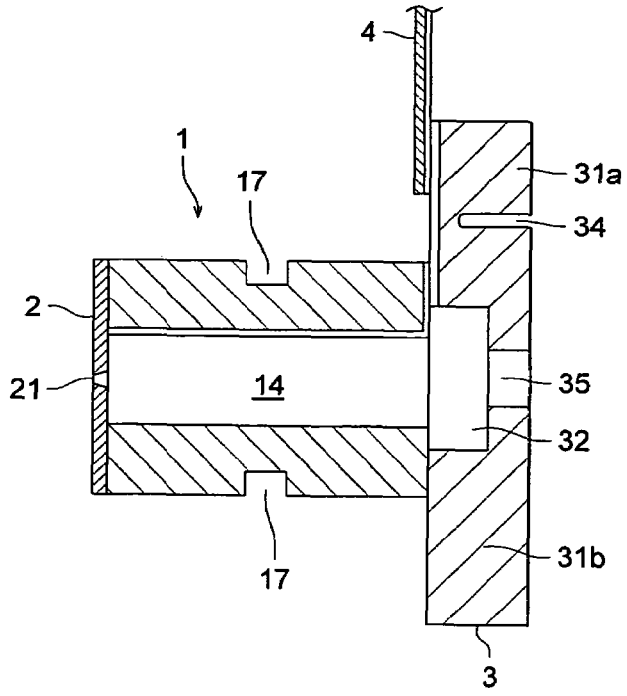
FIGS. 5(*a*) and 5(*b*) are sectional views of an ink-jet head which is another embodiment of this invention.
Figure 5:
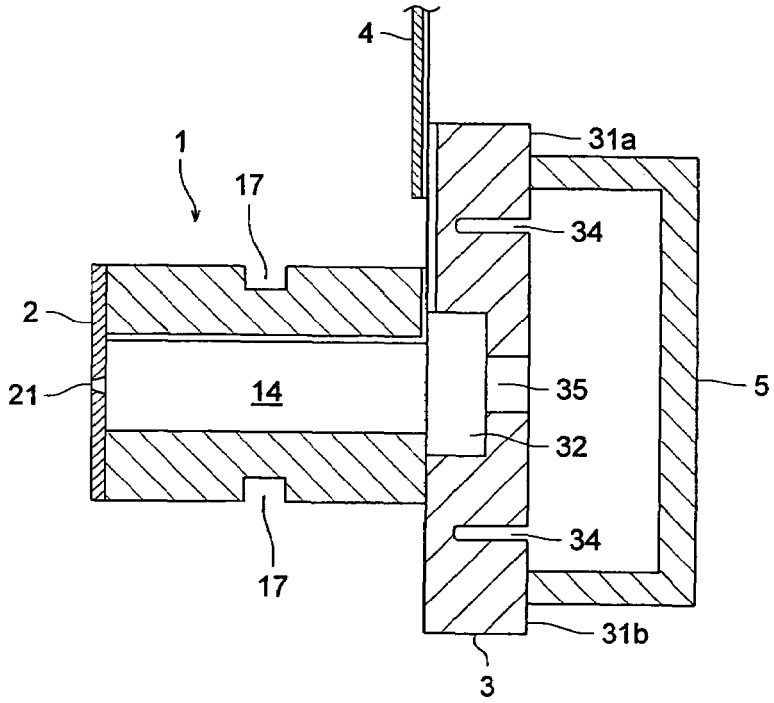

The recessed area 32 cannot store so much ink since the common ink chamber formed by the recessed area 32 is comparatively small. To store more ink, box-shaped ink manifold 5 which can store more ink than the recessed area 32 can be provided to cover the through-hole 35, as shown in FIG. 5(*b*). This invention is not limited to one ink manifold 5. Two or more ink manifolds can be provided along the channel row(s) on the printed circuit board 3. In this case, two or more through-holes 35 are provided on the printed circuit board 3 and the ink manifolds are provided in one-to-one correspondence with the through-holes. However, through-holes 35 need not be one-to-one related to channels 14. One through-hole 35 is provided for every preset number of channels 14. Further, when two or more through-holes 35 are provided, some of the through-holes 35 can be used to supply ink and others can be used to take out ink to make ink circulations in the common ink chamber. To supply ink through the holes 35, the recessed area 32 need not be designed to reach the end of the printed circuit board 3. The recessed area 32 can be formed in the area that contains the channel 14.

Also in the structures of FIG. 5(*a*) and FIG. 5(*b*), the recessed area 32 can have open port 32*a* on either or both ends of the area 32 as shown in FIG. 1. Further, ink can be supplied to the recessed area 32 through either or both of the open port 32*a* and the through-hole 35.

When ink manifold 5 is added as shown in FIG. 5(*b*), the projecting part 31*b* can also have a stress-reducing groove 34 in the same manner as the projecting part 31*a*. By providing the grooves 34 so that the bonded areas of the ink manifold 5 may be outside the grooves, stresses can be reduced on the bonded areas between the head chip 1 and the printed circuit board 3 when ink manifold 5 is bonded to the surface of the printed circuit board 3 after the printed circuit board 3 is attached to the head chip 1. In this case (when the grooves are inside the ink manifold 5), both ends of each groove 34 should be closed or cutting of each groove 34 should stop before it reaches both ends of the printed circuit board 3 to prevent leakage of ink from inside the ink manifold 5.

Reference number 17 in FIG. 1, FIG. 2 and FIG. 5 indicates a positioning groove. The groove 17 is provided on the top and bottom of the head chip 1 by cutting the top and bottom substrates 11 and 12 fully across the substrates. This groove cutting can be done before or after the head substrate assembly is cut into head chips as shown in FIG. 3(*d*). It is preferable to cut the grooves 17 just while the head substrate assembly is cut into head chips. A single cutting process can increase the cutting accuracy.

Figure 6:
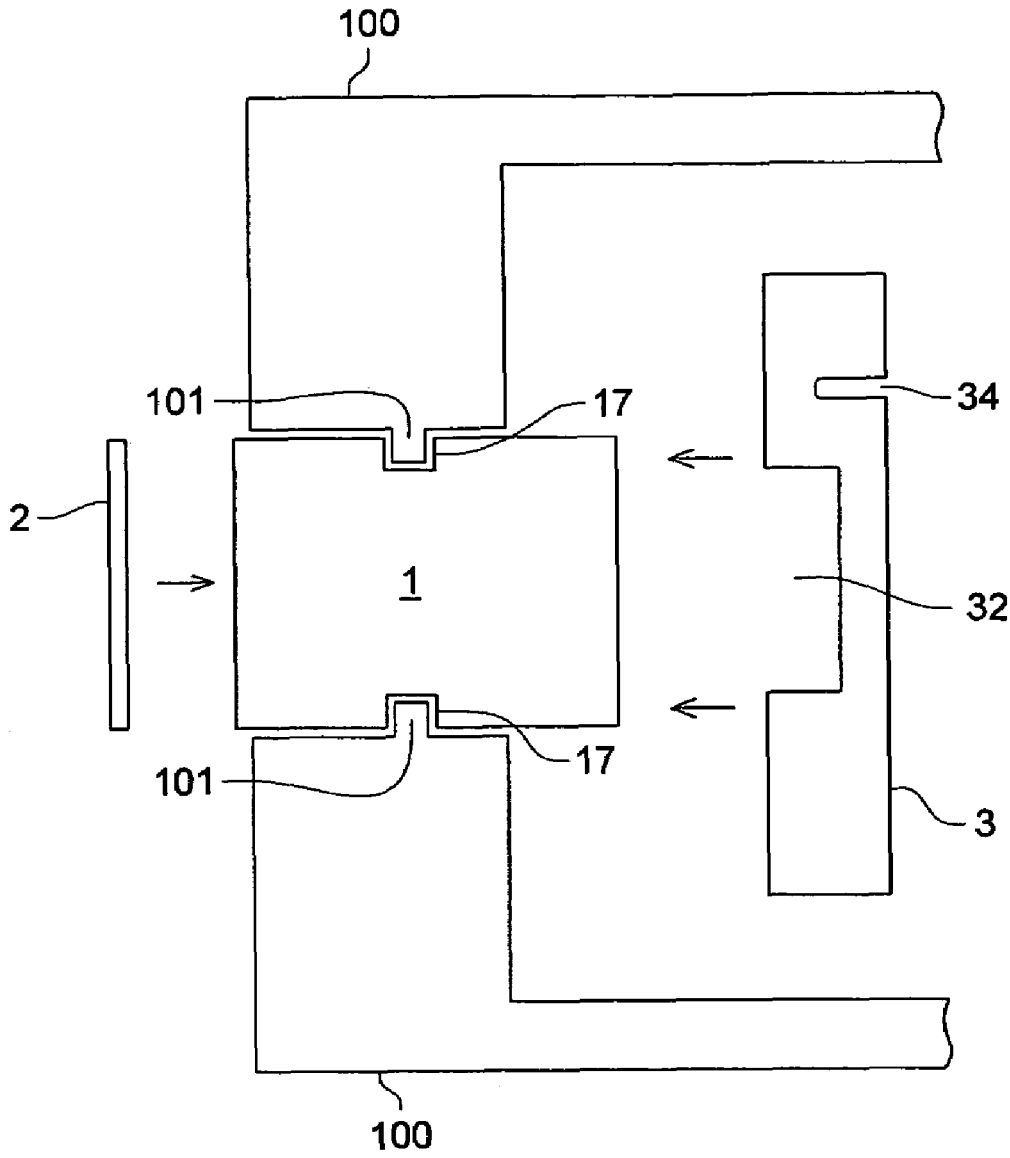
FIG. 6 shows how a head chip is held by a chip holding tool.

As shown in FIG. 6, when printed circuit board 3 is bonded to head chip 1, protrusions 101 of chip holding tool 100 are engaged with grooves 17 to tightly hold the head chip. Nozzle plate 2 and printed circuit board 3 can be easily bonded to the head chip 1 while the head chip is held tightly by the chip holding tool 100. Therefore, when Nozzle plate 2 and printed circuit board 3 are bonded to the head chip, no warpage generates on the head chip and preset pressing forces can be applied to the nozzle plate and the printed circuit board. Either the nozzle plate 2 or the printed circuit board 3 can be bonded first to the head chip. Similarly, ink manifolds 5 can be bonded to the printed circuit board 3 which is bonded to the head chip 1 while the head chip 1 is held tightly by the holding tool 100.

Further, the positioning groove 17 can be used in fixing the ink-jet head to the outer casing, so that the ink-jet head will be attached with extremely high accuracy. Consequently, nozzles can be aligned to the outer casing very accurately.

The positioning grooves 17 need not be provided on both top and bottom sides of the head chip 1. The positioning groove 17 can be provided on either of the top and bottom sides of the head chip 1.

Figure 7:
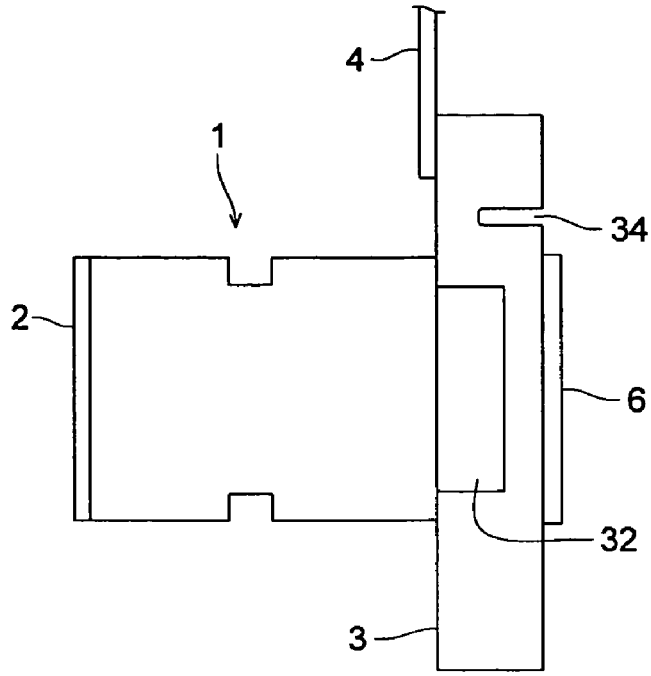
FIG. 7(*a*) shows that a heater is provided on the back of the printed circuit board.
Figure 7:
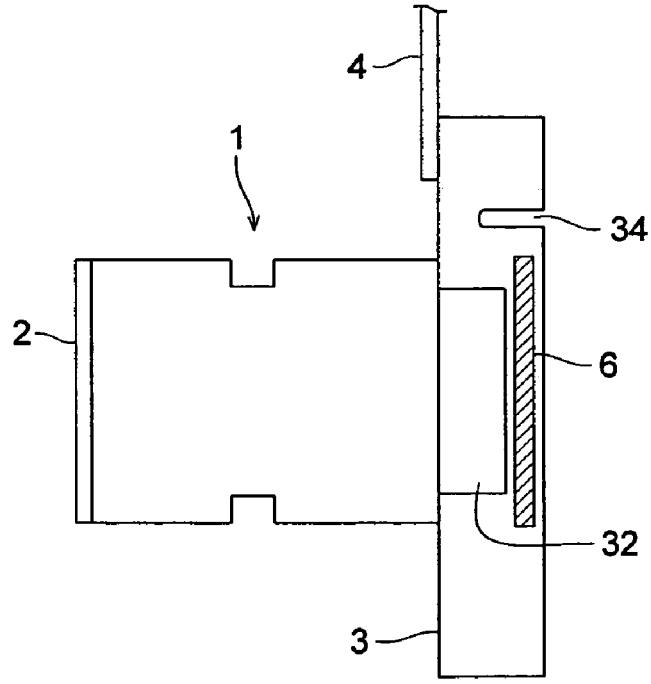

The printed circuit board 3 can be equipped with heater 6 as a heating means to heat ink stored in the recessed area 32 or to control the thermal expansions of the printed circuit board 3 and the head chip 1. FIG. 7(*a*) shows heater 6 provided on the outer surface (or the back) of the printed circuit board 3. The heater 6 is provided by forming a heater electrode pattern on the back of the printed circuit board 3 when wiring electrodes 33 are formed and mounting heater 6 thereon. FIG. 7(*b*) shows heater 6 embedded in the printed circuit board 3. Heater 6 can be embedded in the printed circuit board 3 by putting a heater layer among thin substrate layers and laminating these layers together. In any of the above examples, one or more heaters 6 can be provided.

Although the above description assumes that the head chip 1 of an ink-jet head is equipped with a single channel row, the head chip can have two or more channel rows.

FIG. 8 shows a sectional view of an ink-jet head comprising a head chip 1 having two rows of channels. The head chip 1 having two channel rows can be produced by combining two head chips 1 which were prepared by a method of FIG. 3 so that channels 14A an 14B may be positioned vertically (or perpendicularly to the channel row). In this case, nozzle plate 2 provides nozzles 21A and 21B in one-to-one correspondence with channels 14A and 14B.

Further, the printed circuit board 3 to be bonded to the rear side of the head-chip assembly 1 having two channel lines is equipped with recessed areas 32 which respectively work as a common ink chamber. As shown in FIG. 8(*a*), the printed circuit board 3 can be equipped with a single recessed area 32 which covers all channel inlets 141A and 141B of channels 14A and 14B in two rows. Further, as shown in FIG. 8(*b*), the printed circuit board 3 can be equipped with two recessed areas 32A and 32B which are one-to-one related to two rows of channel inlets-141A and 141B to cover all channel inlets 141A and 141B.

In the structure of FIG. 8(*a*), the recessed area 32 can supply comparatively large quantity of ink to channels 14A and 14B simultaneously since the recessed area 32 is wide enough to contain two channel rows. Further, this structure enables shifting of the nozzle rows and consequently this structure can provide a high-precision ink-jet head.

In the structure of FIG. 8(*b*), recessed areas 32A and 32B for channel rows 14A and 14B can be operated independently. When recessed areas 32A and 32B contain different colors of ink, channel 14A and channel 14B can emit different colors of ink. As the result, one head chip 1 can emit two colors of ink.

When head chip 1 is equipped with 2 rows of channels, connecting wires 16A and 16B are provided separately on substrates 11 and 12 of head chip 1. As the result, connecting wiring electrodes 33A and 33B (to be electrically connected to the wires 16A and 16B) are also provided separately on the surfaces of the projecting parts (banks) 31*a* and 31*b* of the printed circuit board 3. The FPCs 4A and 4B are electrically connected to the wiring electrode 33A and 33B on the projecting parts 31*a* and 31*b*.

A single head chip 1 can be equipped with 3 channel rows or more. When head chip 1 is equipped with 3 channel rows or more, it becomes more difficult to electrically connect the wiring electrodes 33 on the printed circuit board 3 to the connecting electrodes 16 which are drawn from the driving electrodes 15 in channels 14 because of the positional relationship of the recessed areas 32 on the printed circuit board 3. Therefore, when head chip 1 is equipped with 3 channel rows or more, a single recessed area should preferably cover up to two channel rows.

Figure 9:
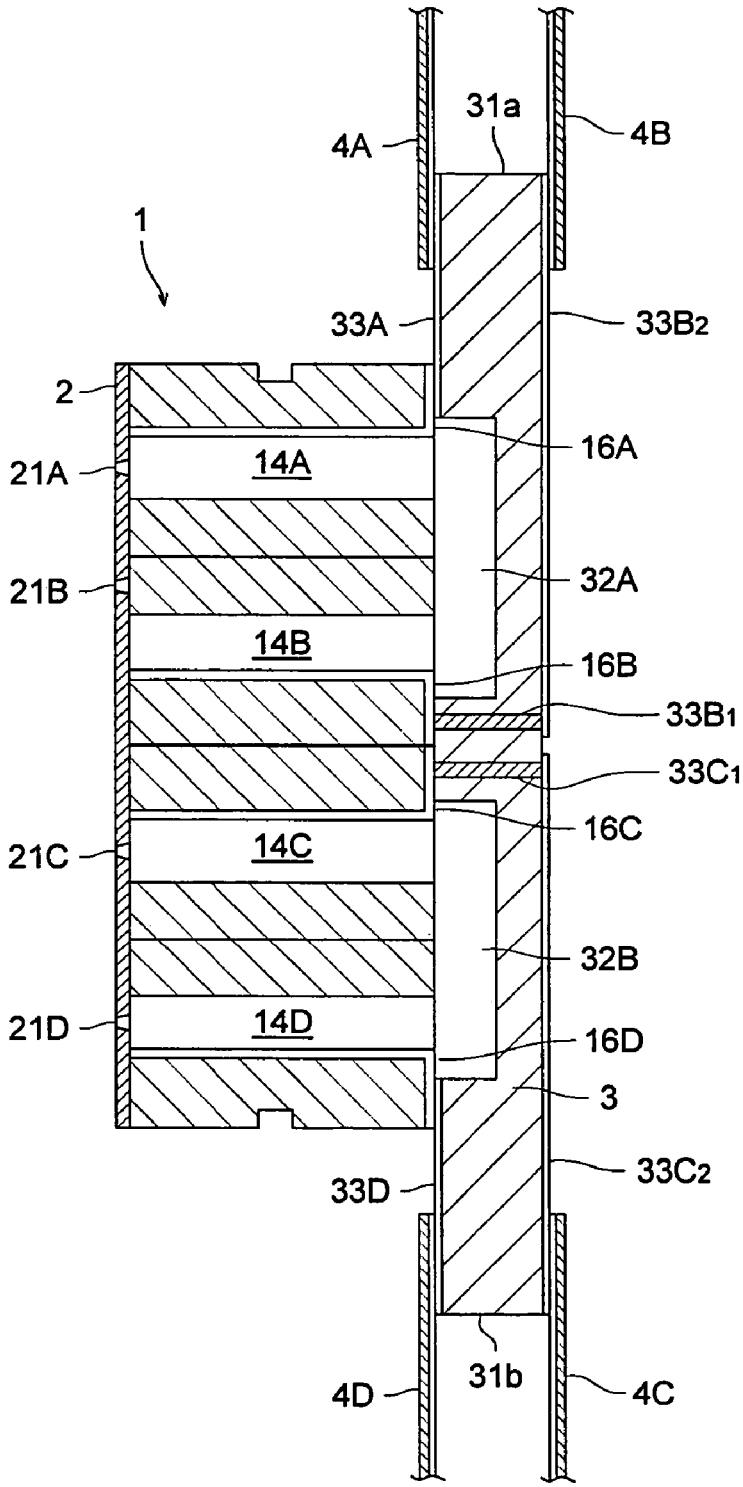
FIG. 9 is a sectional view of an ink-jet head having four rows of channels.

FIG. 9 shows a sectional view of a head chip 1 equipped with 4 channel rows. In this structure, the printed circuit board 3 provides one recessed area 32A for channel rows 14A and 14B and another recessed area 32B for channel rows 14C and 14D. Nozzle holes 21A to 21D of nozzle plate are respectively for channels 14A to 14D.

Connecting electrodes 16A and 16D of channels 14A and 14D which are outermost channels of the four channel rows of the head chip 1 are electrically connected to wiring electrodes 33A and 33D on the front side (to which the head chip is bonded) of the printed circuit board 3. In other words, the connecting electrodes 16A and 16D are drawn to the outer surface of the projecting parts 31*a* and 31*b*. Connecting electrodes 16B and 16C of channels 14B and 14C which are positioned between two recessed areas 32A and 32B are electrically connected to wiring electrodes 33B1 and 33C1 which pass through the printed circuit board 3.

The rear ends of the wiring electrodes 33B1 and 33C1 are electrically connected to wiring electrodes 33B2 and 33C2 which are formed in one-to-one correspondence with channels 14B and 14C on the back of the printed circuit board 3. Accordingly, connecting electrodes 16B and 16C of inner channel rows 14B and 14C are drawn to the outer surface (on the back) of the projecting parts 31*a* and 31*b* by means of the wiring electrodes 33B1 and 33C1 which pass through the printed circuit board 3 and the wiring electrodes 33B2 and 33C2 which are formed on the back of the printed circuit board 3.

Figure 10:
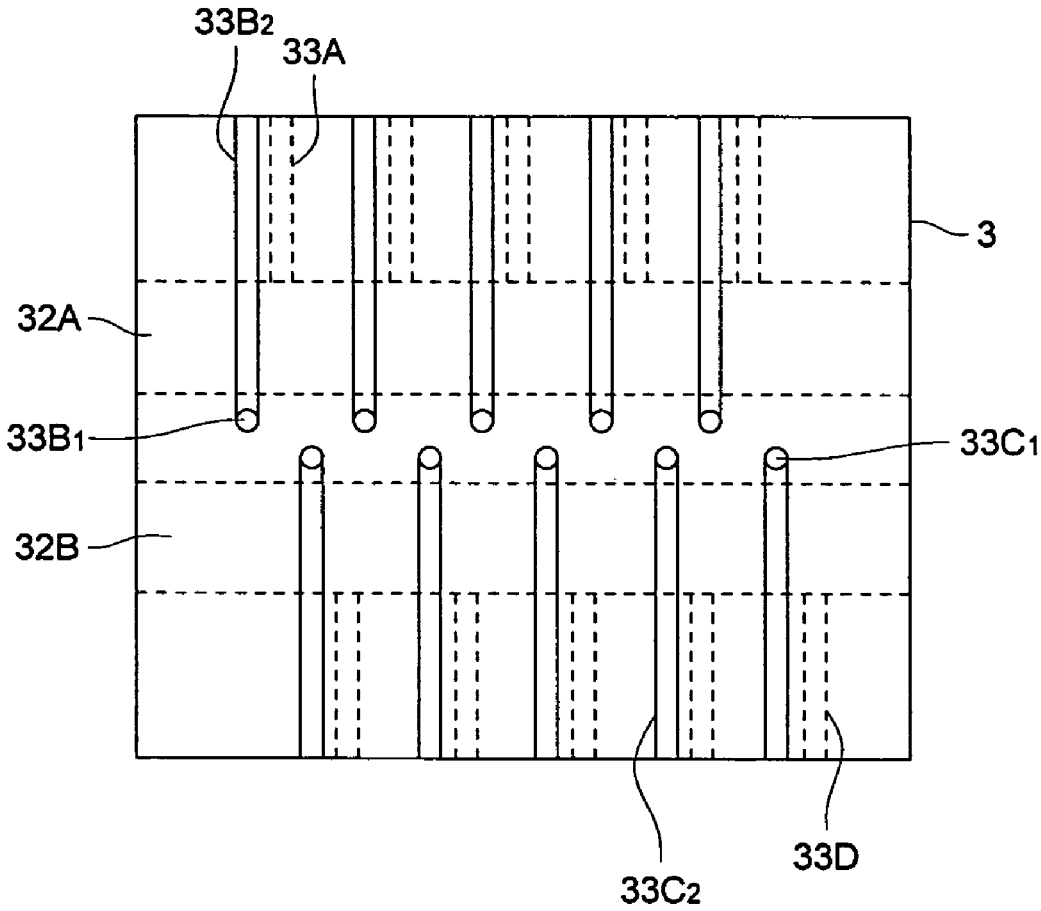
FIG. 10 is a rear view of a printed circuit board to be connected to a head chip equipped with four rows of channels.

FIG. 10 shows the rear view of the printed circuit board 3. Wiring electrodes 33A, 33B1, 33B2, 33C1, 33C2 and 33D are shifted. When ink of a color is supplied to all channels in a 4-channel-row head chip, the ink-jet head can be finer by 4 times than the ink-jet head of a single channel row type.

Wiring electrodes 33A, 33B2, 33C2 and 33D are drawn to both front and back sides of projecting parts 31*a* and 31*b* on the printed circuit board 3. The FPCs (short for flexible printed circuit boards) 4A, 4B, 4C and 4D are connected to these wiring electrodes 33A, 33B2, 33C2 and 33D to pass signals from driving circuits to channels 14A to 14D.

When anisotropic conductive films are used to bond FPCs 4B and 4C to wiring electrodes 33B2 and 33C2, it is preferable that wiring electrodes 33B2 and 33C2 are extended (or drawn) to the surfaces of the projecting parts 31*a* and 31*b*. It is also possible to connect FPCs 4B and 4C directly to wiring electrodes 33B1 and 33C1 by soldering or using anisotropic conductive films.

Wiring electrodes 33B1 and 33C1 which pass through the printed circuit board 3 can be formed by making through-holes by drilling or laser on the printed circuit board 3 and filling the through-holes with conductive paste. This paste electrically connects the front and back surfaces of the printed circuit board 3. When the printed circuit board 3 is made of photosensitive glass, the through-holes can be formed by exposing and developing the photosensitive glass.

Also when the head chip is equipped with 3 channel rows or more, it is possible to provide recessed areas (for common ink chambers) in one-to-one correspondence with channel rows to emit inks of different colors.

The above embodiment can carry out extension of electrodes from driving electrodes and formation of common ink chambers to supply ink for channel rows simultaneously just by bonding a printed circuit board to the rear surface of the head chip. This facilitates production of ink-jet heads equipped with a harmonica head chip without increasing the man-hour. Further, since this embodiment does not require so large electrode fields on front and back sides of the head chip, the resulting ink-jet heads can reduce its size and production cost.

In accordance with the above embodiment, the recessed areas (for common ink chambers) of the printed circuit board are one-to-one corresponding to channel rows. When inks of different colors are supplied to the recessed areas, the head chip can emit ink droplets of different colors.

In accordance with the above embodiment, a recessed area for a common ink chamber covers a plurality of channel rows. This enables supply of comparatively large amount of ink to channels simultaneously. Further, this embodiment can make the ink-jet head more accurate by shifting the nozzle rows.

In accordance with the above embodiment, it is easy to extend the driving electrodes for inner channels just by bonding a printed circuit board to the head chip when the head chip is equipped with 3 channel rows or more.

In accordance with the above embodiment, it is possible to heat ink in the recessed areas and to control the thermal expansion of the printed circuit board to that of the head chip.

In accordance with the above embodiment, the head chip has one or more positioning grooves to be held by a proper chip holding tool. When other members are bonded to the head chip, no warpage generates on the head chip and preset pressing forces can be applied to the members. The grooves can be cut on head chips while a wafer is cut into head chips (in the same process). Therefore, the cutting accuracy is very high. Therefore, if an outer casing is to be used, the head chip can be mounted very accurately. Consequently, the nozzles can be aligned to the casing accurately.

In accordance with the above embodiment, it is possible to reduce stresses on the bonded area of the head chip-and the printed circuit board when FPCs are bonded to the projecting parts of the printed circuit board. This can prevent generation of warpage and bonding failure of the head chip.

Although the present invention has been fully described by the way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An ink-jet head having a front side and a rear side, the ink-jet head comprising:

a plurality of driving walls which are made of piezo-electric elements and positioned at preset intervals in a preset direction, ink channels each of which is sandwiched by the plurality of driving walls to store ink and has an outlet on the front side and an inlet on the rear side in the preset direction, driving electrodes each of which is formed on an inner wall surface of one of the driving walls, connecting electrodes each of which is electrically connected to a respective one of the driving electrodes at the rear side, a printed circuit board which covers a rear part of the ink channels, wiring electrodes each of which is provided on the printed circuit board and electrically connected to a related one of the connecting electrodes, and a common ink chamber which is formed along the preset direction on the printed circuit board to supply ink to the ink channels.

2. The ink-jet head of claim 1, wherein the common ink chamber is a recessed area which is provided in the printed circuit board.

3. The ink-jet head of claim 1, wherein the ink channels are disposed in one or more rows.

4. The ink-jet head of claim 3, wherein the common ink chamber is provided for the channel rows.

5. The ink-jet head of claim 3, wherein the common ink chamber is provided for each of the channel rows.

6. The ink-jet head of claim 3, wherein the channel rows comprise at least three channel rows.

7. The ink-jet head of claim 6, wherein the wiring electrodes corresponding to driving electrodes of a first channel row of the channel rows are provided on an upper part of the printed circuit board, the wiring electrodes corresponding to driving electrodes of a second channel row of the channel rows are extended from the front side to the opposite side through the printed circuit board, and the wiring electrodes corresponding to driving electrodes of a third channel row of the channel rows are provided on a lower part of the printed circuit board.

8. The ink-jet head of claim 1, further comprising:

a heater which is provided on an outer surface of the printed circuit board to heat the printed circuit board.

9. The ink-jet head of claim 1, further comprising:

a heater which is embedded in an outer surface of the printed circuit board to heat the printed circuit board.

10. The ink-jet head of claim 1, further comprising:

a flexible printed circuit to be electrically connected to the wiring electrodes on the printed circuit board.

11. An ink-jet head having a front side and a rear side, the ink-jet head comprising:

a plurality of driving walls which are made of piezo-electric elements and positioned at preset intervals in a preset direction;

an upper substrate which covers top surfaces of the driving walls;

a lower substrate which covers bottom surfaces of the driving walls;

ink channels each of which is enclosed in the driving walls and the upper and lower substrates and has an outlet on the front side and an inlet on the rear side in the preset direction;

driving electrodes each of which is formed on an inner wall surface of each of the driving walls;

connecting electrodes each of which is electrically connected to one of the driving electrodes and extends to the upper or lower substrate away from the ink channels;

a printed circuit board which covers a rear part of the ink channels;

wiring electrodes each of which is provided on the printed circuit board and electrically connected to one of the connecting electrodes; and a common ink chamber which is formed along the preset direction on the printed circuit board to supply ink to the ink channels.

12. The ink-jet head of claim 11, further comprising:

a head positioning groove provided on at least one of the upper and lower substrates.

13. The ink-jet head of claim 11, further comprising:

a flexible printed circuit electrically connected to the wiring electrodes on the printed circuit board.

14. The ink-jet head of claim 13, further comprising:

a groove on the printed circuit board on a side opposite to the wiring electrodes to reduce stress generated when the flexible printed circuit is connected to the wiring electrodes.

* * * * *